United States Patent [19]

Samuelson

[11] Patent Number: 4,957,233

[45] Date of Patent: Sep. 18, 1990

[54] TAPE DISPENSER

[75] Inventor: Bruce E. Samuelson, West Lakeland, Township, County of Washington, Minn.

[73] Assignee: Minnesota Mining and Manufacturing Company, Saint Paul, Minn.

[21] Appl. No.: 351,716

[22] Filed: May 12, 1989

[51] Int. Cl.[5] ..... B26F 3/02

[52] U.S. Cl. ..... 225/26; 225/47

[58] Field of Search ..... 225/25, 26, 39, 46, 225/47, 53, 77, 90

[56] References Cited

U.S. PATENT DOCUMENTS

| | | | |
|---|---|---|---|
| 2,381,229 | 8/1945 | Shalhoub | 225/47 |
| 2,858,086 | 10/1958 | Saphier | 225/47 |
| 3,031,117 | 4/1962 | Maccaferri | 225/47 |
| 3,062,424 | 12/1962 | Stirrup | 225/43 |

*Primary Examiner*—Hien H. Phan

*Attorney, Agent, or Firm*—Donald M. Sell; Walter N. Kirn; William L. Huebsch

[57] ABSTRACT

A refillable tape dispenser including opposed hub portions adapted to project axially into and journal the core of a roll of tape. Each of the hub portions includes cam surfaces having ends ending at an inner surface, which cam surfaces are disposed generally parallel to a first direction in which tape is withdrawn from the dispenser and diverge away from opposite sides of the inner surface. Movement of the tape roll toward the inner surfaces of the opposed hub portions in a direction normal to the first direction will cause the tape roll to engage the cam surfaces and move one hub portion to a release position until the hub portions are aligned with and enter the central opening in the core under the influence of biasing toward that position, whereupon end surfaces of plate like parts of the hub portions will retain and journal the core around the hub portions during withdrawal of tape in the first direction. Upon subsequent movement of the empty core in a direction normal to the first direction the core will also engage the cam surfaces and move the one hub portion to the release position so that the core can be removed from the dispenser.

6 Claims, 2 Drawing Sheets

TAPE DISPENSER

TECHNICAL FIELD

The present invention relates generally to refillable tape dispensers adapted to receive a tape roll of the type comprising a core with a cylindrical inner surface and a length of tape helically wound about the core, and in particular to the means on such a dispenser for supporting the tape roll for rotation about its axis to afford withdrawing tape from the roll in the dispenser.

BACKGROUND ART

Refillable tape dispensers adapted to receive a tape roll of the type comprising a core with a cylindrical inner surface and a length of tape helically wound about the core have included a variety of means for supporting the tape roll for rotation about its axis to afford withdrawing tape from the roll in the dispenser. Cylindrical hubs with projecting axles adapted to be received in the core and to be removably received in journals on the dispenser have commonly been used, but have the disadvantage that they are sometimes discarded with the empty core, and require a separate molding which adds to the cost of the dispenser. Hubs fixed against rotation about which the tape core can rotate have also been used in dispensers. In one known dispenser using such a hub, the hub is attached at one end on a portion of the dispenser that is pivotal from a position transverse of a cavity in which the tape roll is received, in which position a tape roll around the hub is restrained against axial movement by walls of the dispenser defining the cavity, to a position spaced from that cavity at which the tape roll or core can be positioned on or removed from the hub over its distal end. Such a dispenser has the advantage that the hub will not be discarded, but requires that the portion of the dispenser defining the cavity and the portion defining the hub be made separately.

DISCLOSURE OF INVENTION

The present invention provides a refillable tape dispenser adapted to receive a tape roll of the type comprising a core with a cylindrical inner surface and a length of tape helically wound about the core that includes means for supporting the tape roll for rotation about its axis to afford withdrawing tape from the roll in the dispenser that is significantly more simple to manufacture than the dispensers described above.

The means for supporting the tape roll according to the present invention includes opposed hub portions adapted to project axially into the through opening in the core of a roll of tape from opposite sides of the core to afford rotation of the tape roll around the hub portions. Each of the hub portions includes a distal plate like part elongate in the first direction and having an inner surface disposed generally parallel to and in opposition to the inner surface on the opposite hub portion. The plate like part has arcuate end surfaces disposed generally at right angles to the inner surface with one of the end surfaces facing toward the first direction and the other of the end surfaces facing away from the first direction. Each of the hub portions also includes cam parts on opposite sides of the plate like part defining cam surfaces having ends ending at the inner surface, which cam surfaces are disposed generally parallel to the first direction and diverge away from opposite sides of the inner surface of the plate like part. Means are provided for mounting one of the opposed hub portions for movement from a normal position spaced from the other of the hub portions to afford journalling of a tape core on the hub portions, to a release position affording movement of a tape roll or core between the inner surfaces of the opposed hub portions in a direction normal to the axis of the tape roll or core, and means are also provided for biasing the one hub portion to the normal position so that movement of the tape roll toward the inner surfaces of the opposed hub portions in a direction normal to the axis of the tape roll and normal to the first direction will cause the tape roll to engage the cam surfaces to move the one hub portion to the release position in opposition to the biasing means until the hub portions are aligned with and enter the central opening in the core under the influence of the biasing means whereupon the end surfaces will retain and journal the core around the hub portions during withdrawal of tape in the first direction, and so that upon subsequent movement of the core in a direction normal to the axis of the core and normal to the first direction the core will engage the cam surfaces to move the one hub portion to the release position to afford moving the core between the inner surfaces and out of the dispenser.

Preferably, the frame comprises unitary moldings of a resiliently flexible polymeric material including the opposed hub portions with the frame including a projecting part and one of the hub portions adjacent the distal end of the projecting part, and the resilient flexibility of the projecting part provides the means for mounting one of the opposed hub portions for movement between the normal position and the release position and the means for biasing the one hub portion to the normal position.

Also, preferably the dispenser includes at least one guide member fixed on the frame and having a cylindrically concave surface with the guide member being fixed along one side of the opposed hub portions to receive and help guide a peripheral surface of the tape roll to help position the tape roll so that the hub portions align with and enter the central opening in the core under the influence of the biasing means.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
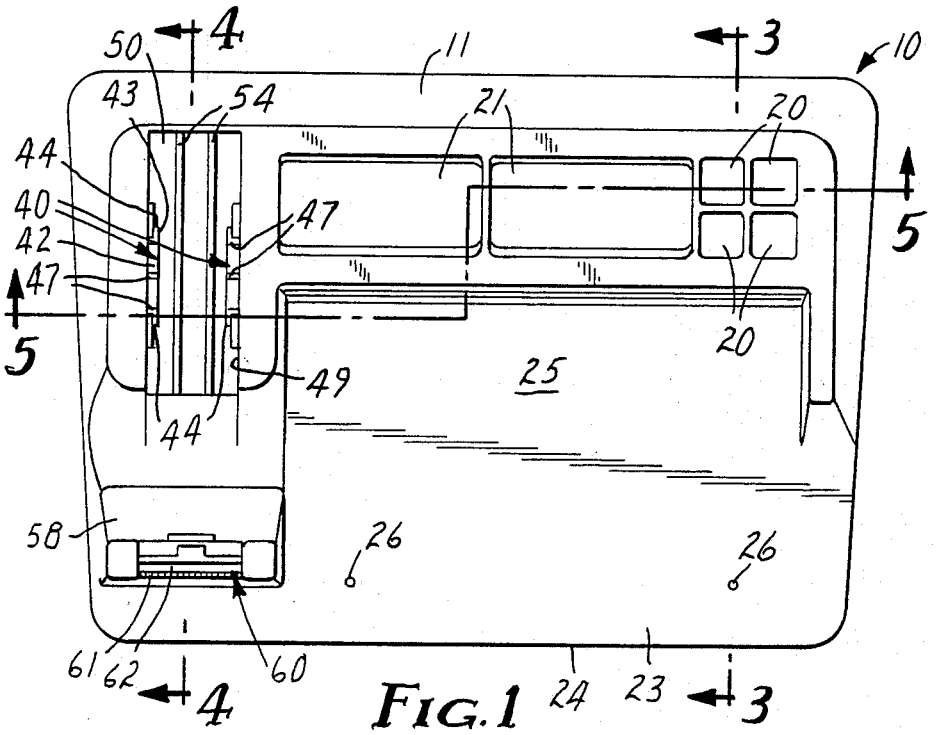
FIG. 1 is a top plan view of a tape dispenser according to the present invention incorporated in a desk organizing structure.
Figure 2:
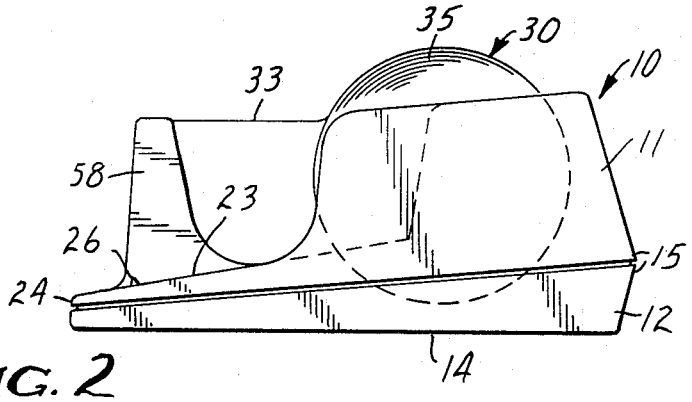
FIG. 2 is an end view of the structure of FIG. 1 with a tape roll shown in the tape dispenser.
Figure 3:
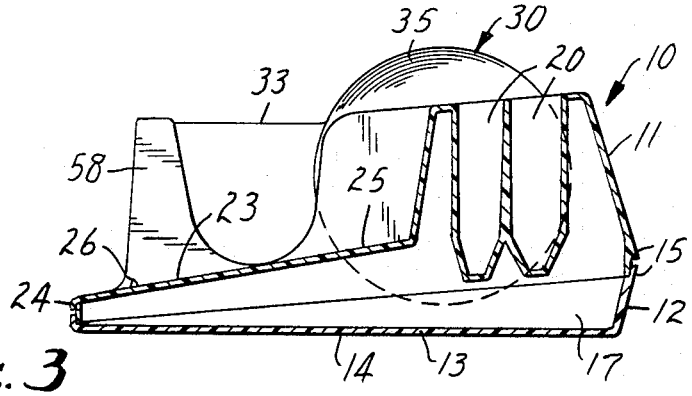
FIG. 3 is a sectional view taken approximately along line 3—3 of FIG. 1.
Figure 4:
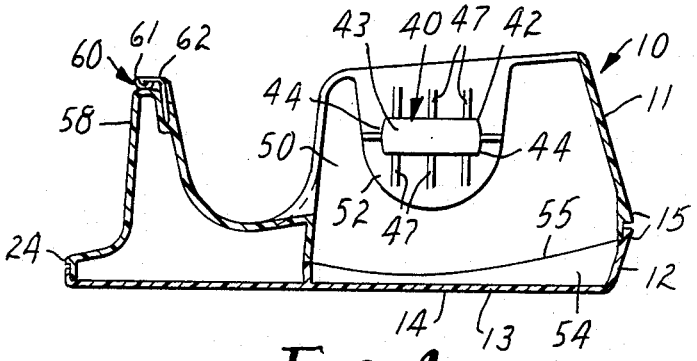
FIG. 4 is a sectional view taken approximately along line 4—4 of FIG. 1 and further illustrating a tape roll in the dispenser.

Referring now to the drawing, there is shown a tape dispenser according to the present invention shown incorporated in a disk organizing structure generally designated by the reference numeral 10. Generally the desk organizing structure 10 comprises a top portion 11 and a bottom portion 12 both molded from a polymeric material (e.g., Polystyrene). The bottom portion 12 includes a generally planar bottom wall 13 having a bottom surface 14 adapted to be supported on a horizontal support surface, from which bottom wall 13 peripheral walls project upwardly and are joined by an adhesive or otherwise along overlapping edges 15 to downwardly projecting peripheral walls of the top portion 11 to define a cavity 17 between the portions 11 and 12 in which sand or another suitable weighting material is contained to provide a desired weight for the structure 10. The top portion 11 also includes walls defining four small generally rectangular sockets 20 adapted for receiving portions of pens or pencils and two larger generally rectangular sockets 21 adapted to receive portions of note pads or the like, which sockets 20 and 21 open through a top surface of the structure 10. The top portion 11 also includes a planar upper surface portion 23 slightly inclined downwardly toward a front edge 24 of the structure 10, which surface portion 23 is adapted to support a "Post-it" brand note pad of the type commercially available from Minnesota Mining and Manufacturing Company, St. Paul, Minn. The surface portion 23 includes a very smooth area 25 opposite the front edge 24 to which repositionable adhesive on the bottom note in such a pad can be adhered, and small spaced abutments 26 project above the surface portion 23 adjacent the front edge 24 of the structure 10 in a position to engage an edge of such a note pad and thereby restrict movement of the note pad on the structure 10 when a note is remove from the pad.

Also included in the desk organizing structure 10 is the tape dispenser according to the present invention which can be incorporated as part of the desk organizing structure 10 as illustrated, or alternatively, can be made as a separate structure (not illustrated). The tape dispenser is adapted to receive a conventional tape roll 30 of the type comprising a core 31 having an axis, a cylindrical inner surface about the axis defining a through opening, and a length of tape 33 helically wound about a cylindrical peripheral surface of the core 31 to form a cylindrical outer surface for the tape roll 30, which tape roll and core 31 have generally planar opposite side surfaces (i.e., the ¾ wide inch tape roll commercially available as "Scotch" brand "Magic" transparent tape from Minnesota Mining and Manufacturing Company, St. Paul, Minn.).

Figure 5:
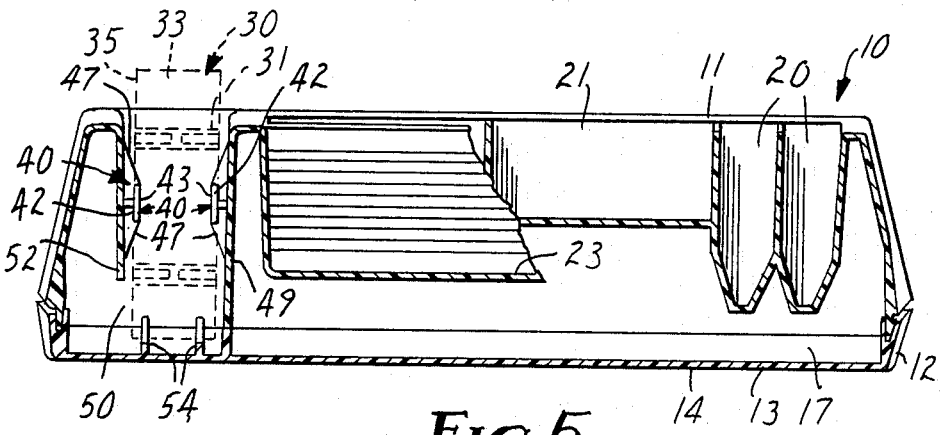
FIG. 5 is a sectional view taken approximately along line 5—5 of FIG. 1 with a transversely sectioned tape roll shown in dotted outlined in the tape dispenser.

The tape dispenser comprises a frame provided by parts of the top and bottom portions 11 and 12 of the structure 10, and novel means for supporting the tape roll 30 for rotation about its axis to afford withdrawing tape from the tape roll 30 in a first direction relative to the frame or structure 10, which first direction is generally parallel to the bottom surface 14 of the structure 10, and extends toward and at a right angle to the front edge 24 of the structure 10. That novel means for supporting the tape roll 30 comprises opposed hub portions 40 adapted to project axially into the through opening in the core 31 of the tape roll 30 from opposite sides of the core 31 to afford rotation of the tape roll 31 around the opposed hub portions 40. Each of the hub portions 40 includes a distal plate like part 42 that is elongate in the first direction in which the tape is withdrawn, has a generally planar inner surface 43 disposed generally parallel and in opposition to the inner surface 43 on the opposite hub portion 40, and has arcuate end surfaces 44 disposed at right angles to the inner surface 43 and disposed at the ends of the elongate plate like part 42 with one end surface 44 facing toward the first direction and front edge 24 and the other end surface 44 facing away from the first direction and front edge 24 of the structure 10. Each of the hub portions 40 also includes cam parts in the form of spaced projecting cam walls on opposite sides of the plate like part 42, which cam walls have distal edges that define cam surfaces 47 on opposite sides of the plate like part 42 that have ends ending at and converging smoothly with the inner surface 43. The cam surfaces 47 are disposed generally parallel to the first direction, and diverge away from opposite sides of the inner surface 43. One of the hub portions 40 is fixed to a wall 49 included in the top portion 11 that is disposed at a right angle to the bottom wall 13, helps to define a cavity 50 in the top portion 11 in which the tape roll 30 is received, and is attached to other walls around its periphery so that it is relatively inflexible. The other of the hub portions 40 is fixed at the distal end of a cantilevered part 52 of the top portion 11, which cantilevered part 52 defines the side of the cavity 50 for the tape roll 30 opposite the wall 49, projects toward the bottom wall 13, and is resiliently flexible to provide both (1) means for mounting the hub portion 40 it carries adjacent its distal end for movement between a normal position (see FIGS. 1 and 5) spaced from the other hub portion 40 to afford journalling of the inner surface of the tape core 31 on the hub portions 40, to a release position (see FIGS. 6 and 7) affording movement of the side surfaces 35 of the tape roll 30 or of its core 31 between the cam and inner surfaces 47 and 43 of the opposed hub portions 40 in a direction normal to the axis of the tape roll 30 or core 31; and also (2) means for biasing the hub portion 40 it carries to the normal position.

Figure 6:
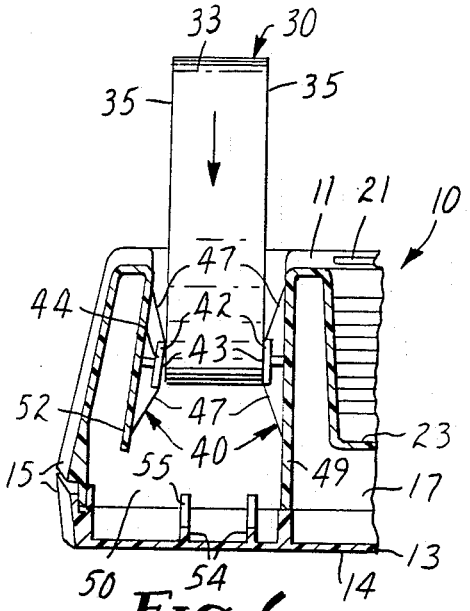
FIGS. 6 and 7 are fragmentary sectional views taken approximately along line 5—5 of FIG. 1 which respectively illustrate loading a tape roll into the tape dispenser and removing an empty core from the tape dispenser.
Figure 7:
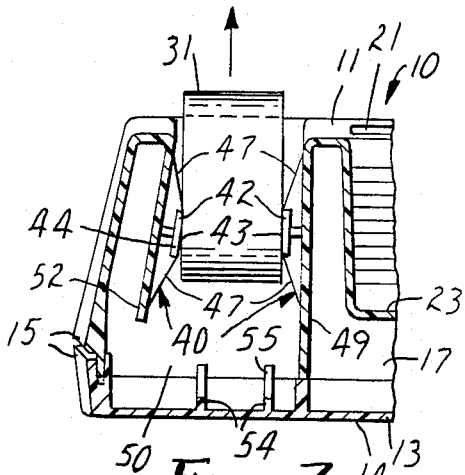

As is best seen in FIG. 6, movement of the tape roll 30 toward the inner surfaces 43 of the opposed hub portions 40 in a direction normal to the axis of the tape roll 30 and normal to the first direction in which the tape is withdrawn from the tape dispenser will cause the leading edge of the tape roll 30 to engage the cam surfaces 47 on the hub portions 40 opposite the bottom wall 13 and thereby move the hub portion 40 on the flexible cantilevered part 52 to the release position in opposition to the biasing means provided by flexing of that part 52 until the hub portions 40 are aligned with and enter the central opening in the core 31 under the influence of that biasing means; whereupon the end surfaces 44 on the plate like parts 42 will retain and journal the inner surface of the core 31 around the hub portions 40 during withdrawal of tape in the first direction. Upon subsequent movement of the empty core 31 in a direction normal to the axis of the core 31 and normal to the first direction in which the tape is withdrawn from the dispenser (as is illustrated in FIG. 7) the leading inner surface portion of the core 31 will engage the cam surfaces 47 adjacent the bottom wall 13 to move the hub portion 40 on the cantilevered part 52 to the release position by resilient bending of the part 52 to afford moving the core 31 between the cam and inner surfaces 47 and 43 and out of the tape dispenser.

The frame for the tape dispenser further includes at least one, and as illustrated, a pair of parallel guide members 54 fixed on and projecting upwardly into the cavity 50 from the side of the bottom wall 13 opposite the bottom surface 14. The guide members 54 each have a cylindrically concave distal surface 55 having an axis, facing away from the bottom wall 13 and adapted to correspond with a minor portion of the peripheral surface of the tape roll 30. The opposed hub portions 40 are position in spaced relationship above, centered on and flanking the concave surfaces 55 with their inner surfaces 43 at a right angle to the bottom surface 14 and the axis of the cylindrically concave surfaces 55 at a right angle to the first direction in which the tape is withdrawn from the dispenser. The concave inner surfaces 55 are spaced from the opposed hub portions 40 and located to receive and help guide the tape roll 30 being loaded into the tape dispenser to a position at which the hub portions 40 are aligned with and can enter the central opening in the core under the influence of the biasing means provided by the deflected cantilevered part 52.

As is conventional, the tape dispenser further comprises a upwardly projecting part 58 defined by walls of the top portion 11. The projecting part 58 is spaced from the walls defining the cavity 17 in which the tape roll 30 is received and provides means for mounting a metal cut off blade 60 having a serrated tape cutting edge 61 and a planar land surface 62 parallel to and adjacent the serrated edge 61 with the cut off blade 60 spaced from the opposed hub portions 40 in the first direction in which the tape is withdrawn, with the serrated edge 61 transverse to the first direction so that tape withdrawn from the dispenser can be manually severed on the edge 61, and with the land surface 62 between the serrated edge 61 and the opposed hub portions 40 so that a newly severed end portion of the tape will be adhered to the land surface 62 in a position so that a user can subsequently insert his finger under the tape in the space adjacent the projecting part 58 to facilitate pealing the end portion of the tape from the land surface 62 so that an additional length of tape can be withdrawn from the tape roll 30.

The present invention has now been described with reference to one embodiment thereof. It will be apparent to those skilled in the art that many changes can be made in the embodiment described without departing from the scope of the present invention. Thus the scope of the present invention should not be limited to the structure described in this application, but only by structures described by the language of the claims and the equivalents of those structures.

I claim:

1. In a tape dispenser adapted to receive a tape roll of the type comprising a core having an axis, a cylindrical inner surface about the axis defining a through opening, and a length of tape helically wound about the core to provide a cylindrical outer surface for the tape roll, with the tape roll and core having generally planar opposite sides, said dispenser comprising a frame and means on the frame for supporting the tape roll for rotation about its axis to afford withdrawing tape from the roll in a first direction relative to the frame, the improvement wherein said means for supporting the tape roll comprises opposed hub portions adapted to project axially into the through opening in the core from opposite sides to afford rotation of the tape roll around said hub portions, each of said hub portions including a distal plate like part elongate in said first direction and having an inner surface disposed generally parallel to and in opposition to the inner surface on the opposite hub portion, said plate like part having arcuate end surfaces disposed generally at right angles to said inner surface with one of said end surfaces facing toward said first direction and the other of said end surfaces facing away from said first direction, and cam parts on opposite sides of said plate like part defining cam surfaces having ends ending at said inner surface, said cam surfaces being disposed generally parallel to said first direction and diverging away from opposite sides of said inner surface, and means for mounting one of said opposed hub portions for movement from a normal position spaced from the other of said hub portions to afford journalling of a said tape core on said hub portions, to a release position affording movement of a said tape roll or core between said inner surfaces of said opposed hub portions in a direction normal to the axis of said tape roll or core, and means for biasing said one hub portion to said normal position so that movement of the tape roll toward said inner surfaces of said opposed hub portions in a direction normal to the axis of the tape roll and normal to said first direction will cause the tape roll to engage said cam surfaces to move said one hub portion to said release position in opposition to said biasing means until said hub portions are aligned with and enter the central opening in the core under the influence of said biasing means whereupon said end surfaces will retain and journal the core around said hub portions during withdrawal of tape in said first direction, and so that upon subsequent movement of said core in a direction normal to the axis of the core and normal to said first direction the core will engage said cam surfaces to move said one hub portion to said release position to afford moving said core between said inner surfaces and out of said dispenser.

2. A dispenser according to claim 1 wherein said frame comprises a unitary molding of a resiliently flexible polymeric material including said opposed hub portions with said frame including a projecting part having a distal end and one of said hub portions adjacent said distal end so that the resilient flexibility of said projecting part of said frame provides said means for mounting one of said opposed hub portions for movement between said normal position and said release position and said means for biasing said one hub portion to said normal position.

3. A dispenser according to claim 1 further including at least one guide member fixed on said frame and having a cylindrically concave surface adapted to correspond with a minor portion of the peripheral surface of a said tape roll, said guide member being fixed along one side of said opposed hub portions to receive and help guide that peripheral surface to a position at which said hub portions are aligned with and can enter the central opening in the core under the influence of said biasing means.

4. A dispenser according to claim 1 wherein said frame includes a bottom wall having a generally planar bottom surface adapted to be supported on a horizontal support surface, said first direction is parallel to said bottom surface, said frame further includes at least one guide member fixed on the side of said bottom wall opposite said bottom surface and having a cylindrically concave surface having an axis, facing away from said bottom wall and adapted to correspond with a minor portion of the peripheral surface of a said tape roll, said opposed hub portions are positioned in spaced relationship above, centered on and flanking said concave surface with said inner surfaces at a right angle to said bottom surface and said axis of said cylindrically concave surface at a right angle to said first direction, said concave inner surface being spaced from said opposed hub portions to receive and help guide that peripheral surface to a position at which said hub portions are aligned with and can enter the central opening in the core under the influence of said biasing means.

5. A dispenser according to claim 4 wherein said frame comprises a unitary molding of a resiliently flexible polymeric material including said opposed hub portions with said frame including a projecting part having a distal end portion adjacent said bottom wall and one of said hub portions adjacent said distal end so that the resilient flexibility of said projecting part provides said means for mounting one of said hub portions for movement between said normal position and said release position and said means for biasing said one hub portion to said normal position.

6. A dispenser according to claim 1 further comprising a metal cut off blade having a serrated edge and a generally planar land surface parallel to and adjacent said serrated edge; and a portion of said frame mounting said cut off blade with said cut off blade spaced from said opposed hub portions in said first direction with said serrated edge transverse to said first direction and said land surface between said serrated edge and said opposed hub portions.

* * * * *